US005159967A

United States Patent [19]

Ashley et al.

[11] Patent Number: 5,159,967

[45] Date of Patent: Nov. 3, 1992

[54] IMPROVEMENTS IN AND RELATING TO ROLLER DOORS

[75] Inventors: Paul Ashley; John U. Chapman, both of Carlisle, England

[73] Assignee: Clark Door Limited, Carlisle, England

[21] Appl. No.: 700,048

[22] Filed: May 8, 1991

Related U.S. Application Data

[63] Continuation of Ser. No. 532,750, Nov. 30, 1989, abandoned, which is a continuation of Ser. No. 61,698, Jun. 12, 1987, abandoned.

[30] Foreign Application Priority Data

Jan. 17, 1987 [GB] United Kingdom ..... 8700987

[51] Int. Cl.[5] ..... A47G 5/02

[52] U.S. Cl. ..... 160/265; 160/189; 160/310

[58] Field of Search ..... 160/311, 201, 265, 238, 160/320, 310, 133, 189, 190, 191; 49/27, 28

[56] References Cited

U.S. PATENT DOCUMENTS

| | | | |
|---|---|---|---|
| 778,228 | 12/1904 | Dodge et al. | 160/265 X |
| 3,299,570 | 1/1967 | Radcliffe | 49/28 X |
| 3,303,303 | 2/1967 | Miller | 49/27 X |
| 3,878,879 | 4/1975 | Manns | 160/273 |
| 4,133,365 | 1/1979 | Schleicher . | |

FOREIGN PATENT DOCUMENTS

| | | | |
|---|---|---|---|
| 0125217 | 1/1985 | European Pat. Off. . | |
| 3245009 | 6/1984 | Fed. Rep. of Germany | 160/311 |
| 112654 | of 1918 | United Kingdom | 160/320 |
| 503774 | 4/1939 | United Kingdom | 160/322 |
| 1444017 | 8/1973 | United Kingdom . | |

*Primary Examiner*—Blair M. Johnson

*Attorney, Agent, or Firm*—Rogers, Howell & Haferkamp

[57] ABSTRACT

A roller door assembly has means for tensioning same wherein a load is applied to a bottom edge of the roller and means for counterbalancing the weight of the door wherein a load is applied to the roller, the loads exerted by both said means being dependent on the amount of door off the roller.

9 Claims, 3 Drawing Sheets

IMPROVEMENTS IN AND RELATING TO ROLLER DOORS

This is a continuation of application Ser. No. 07/532,750 filed on Nov. 30, 1989, which was a continuation of application Ser. No. 07/061,698 filed on Jun. 12, 1987, both now abandoned.

This invention concerns roller doors.

Roller doors are often used to close large openings in garage, warehouse and factory situations, where space may be usefully saved. Such roller doors of continuous sheet or slatted construction are attached to a motor drive roller positioned horizontally over a door opening so that opening and closing of the door is by by vertical movement thereof. To avoid the door flapping it is desirable that the door be maintained under tension. Furthermore to facilitate rolling and unrolling of the door counterbalancing of the door is desirable.

An object of this invention is to provide means for tensioning and counterbalancing a roller door.

According to this invention there is provided a roller door having means for tensioning same wherein a load is applied to a bottom edge of the roller and means for counterbalancing the weight of the door, wherein a load is applied to the roller, the loads exerted by both said means being dependent on the amount of door off the roller.

The tensioning means preferably comprises a wire or the like attached at one end at or near the bottom edge of the door and at the other to a fixed point, the wire or the like passing through a pulley system, one pulley thereof being movable and having a load applied thereto. The load may be applied, for example, by a weight, a spring or a weight and a spring.

In a preferred embodiment, the tensioning means has the wire from the door passing under a fixed pulley, up over a second fixed pulley, under the movable pulley and upto an attachment point.

A tensioning means is preferably provided on both sides of the door, the wires or the like of each said means being attached to the ends of a bottom beam for the door.

The counterbalancing means preferably comprises a drum attached to one end of the door roller and a wire on the drum that passes under a movable pulley and upto a fixed point. The pulley preferably carries a weight and/or a spring for exerting a load thereon. The wire is intended to roll onto the drum in the opposite direction to that in which the door rolls onto its roller so that the load applied to the drum which may be fixed or variable (when a spring or similar is incorporated) balances the load on the roller.

In addition, the counterbalancing load is preferably chosen to compensate also for the load of the tensioning means. Further exemplary explanation is given below with reference to the accompanying drawings.

As the optimum counterbalancing force is substantially equal to the product of the weight of the door off the roller and the roller radius, which is variable, means for compensating for that variation may be desirable in the roller assembly of the invention. That variation may be accommodated by connecting the lower end of the door by a wire or cable to spring means, the spring being slack when the door is closed and taut when the door is open. The cable or wire preferably passes from the door under a lower fixed pulley, up to and over an upper fixed pulley, down and under a movable pulley to which one end of the spring means is attached and up to a fixing point. The other end of the spring means is itself fixed.

Because roller doors can be damaged or can cause damage by impact on an object in the doorway, it is further proposed by the invention to provide a means whereby operation of a motor for the door may be stopped and/or reversed upon impact.

According to a second aspect of the invention there is provided a safety beam for a roller door of resilient foam or sponge material containing pneumatic tubes connected to a pneumatic switch for stopping and/or reversing the door motor.

The beam is preferably of rectangular section and advantageously has a greater depth than width, whereby the immediate effect of any impact may be absorbed by the beam. It must be said, of course, that the pneumatic switch is preferably as sensitive as possible so that it operates as quickly as possible after impact.

The beam preferably contains two pneumatic tubes one in each of the lower quarters of the beam.

This invention will now be further described by way of example only, with reference to the accompanying drawings, in which.

Figure 1:
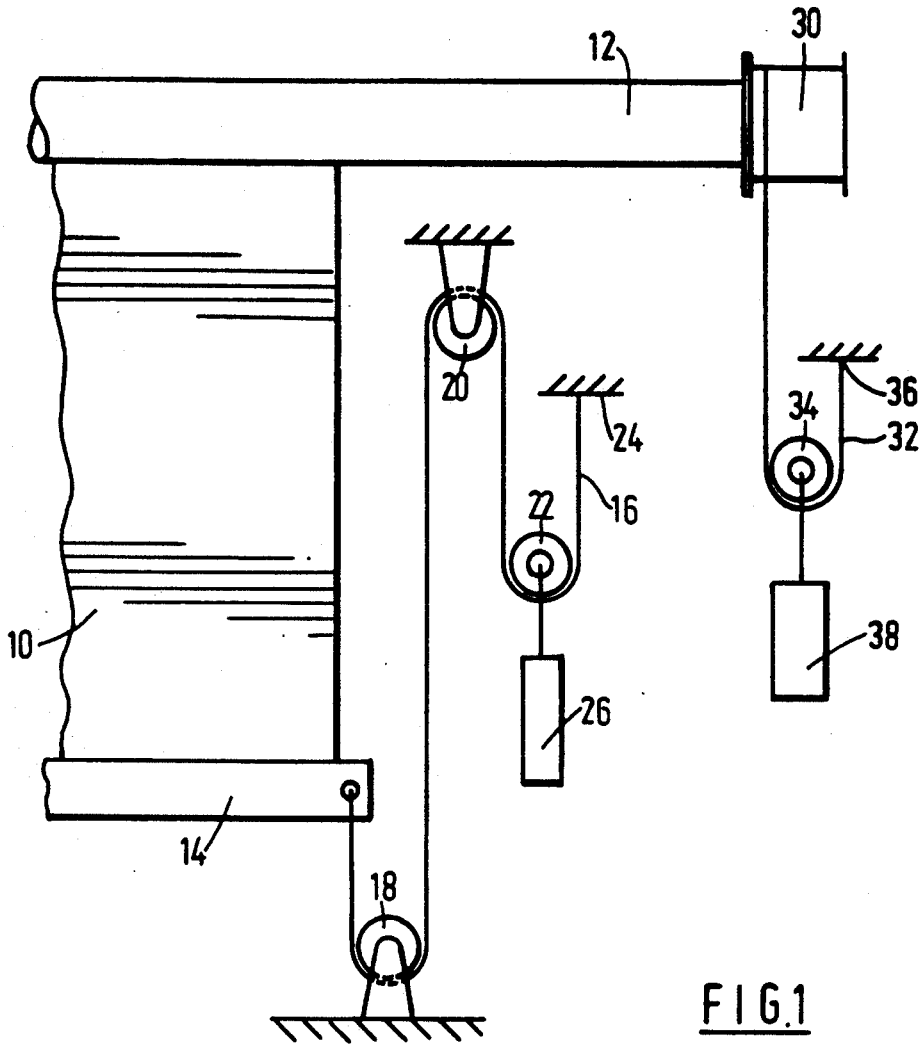
FIG. 1 shows schematically a roller door assembly.

Referring to FIG. 1 of the accompanying drawings, a roller door 10 of continuous sheet construction is attached to a roller 12 of radius RF along its top edge. The bottom edge of the door 10 carries a bottom beam 14 to each end of which are attached tensioning wires 16. The tensioning wires pass from the beam 14 under a lower fixed pulley 18 over an upper fixed pulley 20, under a movable pulley 22 and finally upto an attachment point 24. The movable pulley 22 has means 26, such as a weight, a spring or a weight and a spring, exerting a load W thereon.

One end of the roller 12 has a drum 30 of radius RD to which is attached and upon which rolls up a wire 32. The wire 32 rolls up on the drum 30 in the opposite direction to that in which the roller door 10 rolls onto the roller 12. The wire 32 passes from the drum under a movable pulley 34 upto an attachment point 36. The movable pulley 34 has a counterbalancing means 38 such as a weight, a spring or a weight and a spring, exerting a load CF thereon.

The tensioning and counterbalancing systems described above are intended to operate together in maintaining tension and balance and so careful selection of parameters is of importance. Although with weights only as the load exerting means, because of the change in radius of the door and roller combined as the door is rolled or unrolled, balance may not be achievable over the whole range of movement of the door, the use of springs alone or with weights may provide sufficient variation in load to give balance over substantially the whole range of movement of the door.

The mode of operation of the tensioning and balancing systems described above can be easily seen from the drawings. The pulley arrangement of the tensioning system is intended to provide sufficient extra load on the bottom of the door in order to keep it under tension according to how much of the door is unrolled.

The counterbalancing pulley system is intended to provide more or less load on the drum hence the roller in accordance with how much of the door is unrolled and load thereon from the tensioning means.

In choosing parameters for the various components of the tensioning and counterbalancing systems described above, assuming that the weight of the door and beam is WF, the following equation is believed to be of importance for balance:

$$RF(WF+W/2\times 2)=RD\times CF/2$$

$$RF(WF+W)=RD\times CF/2$$

Figure 2:
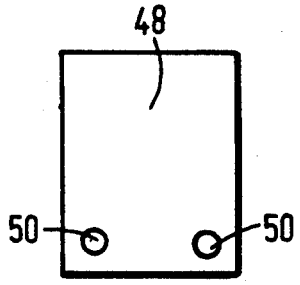
FIG. 2 shows in section a safety beam of a roller door.

Turning to FIG. 2, the bottom beam 14 carries safety beam 48 constructed of greater depth than width constructed principally of resilient foam or sponge material that contains two pneumatic tubes 50 one in each of the lower quarters of the beam connected to a pneumatically operated electric switch (not shown). The switch is arranged to stop and/or reverse the motor that operates the door roller for opening and closing of the door upon an increase in pressure within the pneumatic tubes 50. Such an increase in pressure will be caused by impact of the safety beam upon an object or person obstructing downward movement of the door.

Figure 3:
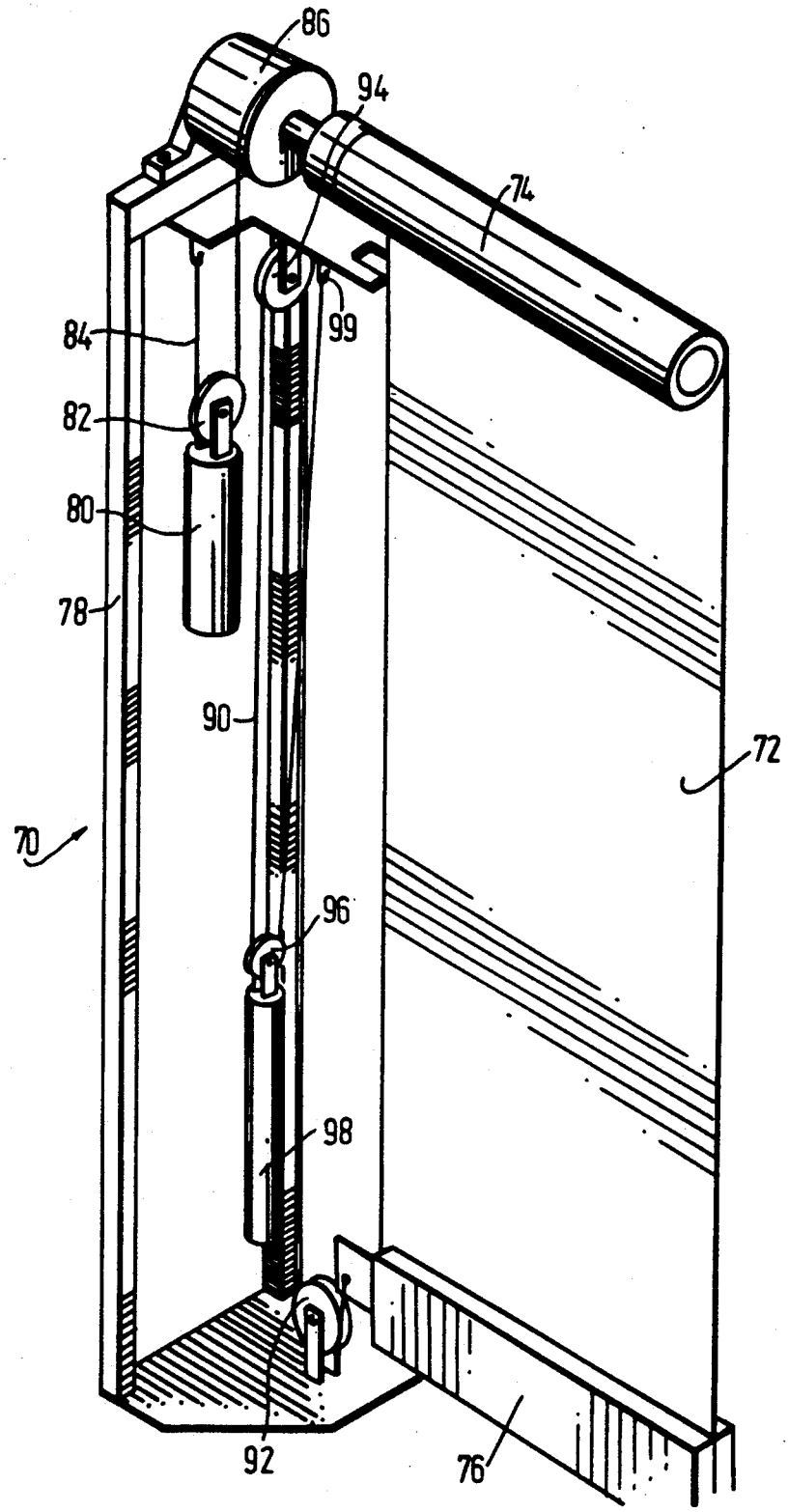
FIG. 3 shows arrangement at one side of another roller door assembly.
Figure 4:
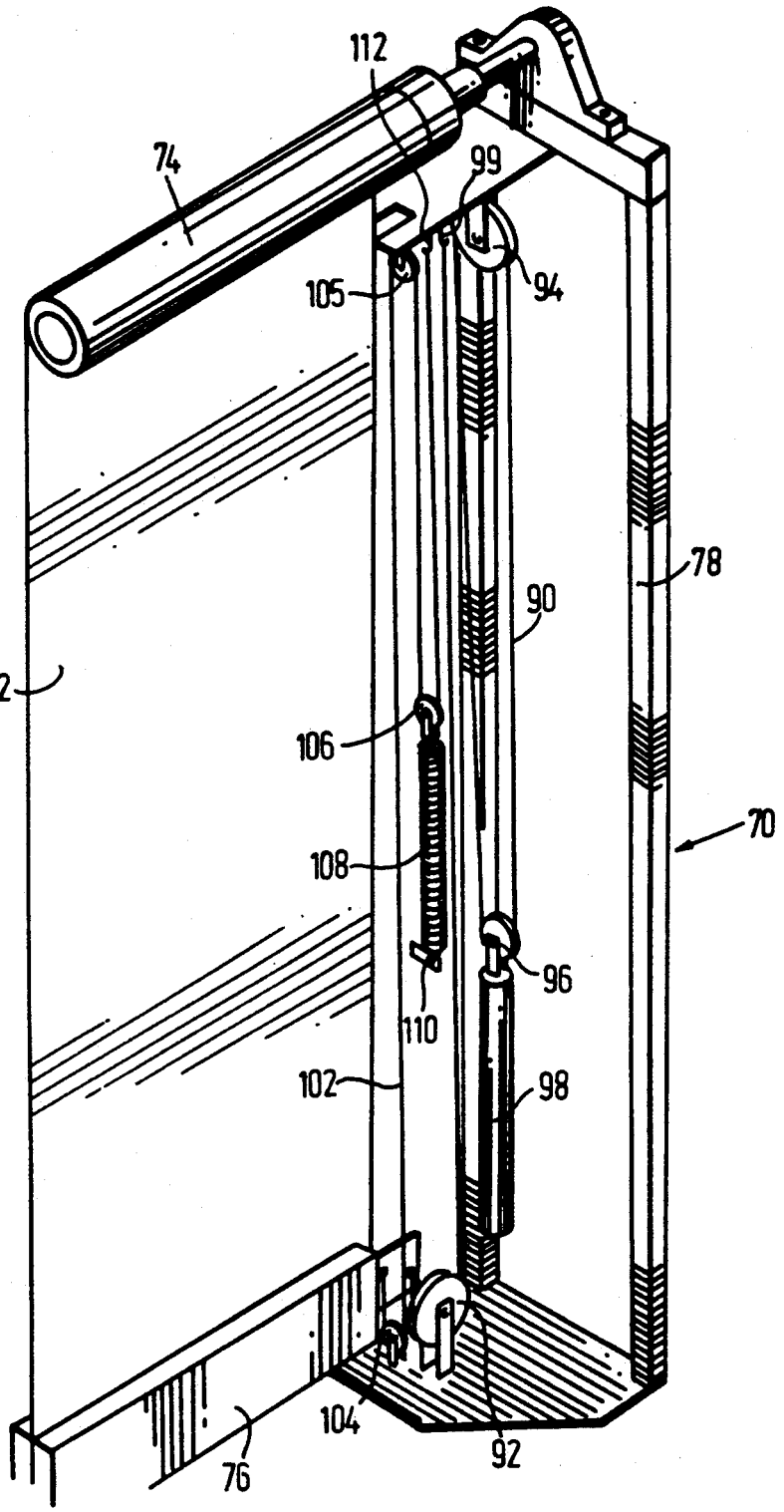
FIG. 4 shows the arrangement at the other side of the roller door of FIG. 3.

Turning to FIGS. 3 and 4, a roller door assembly 70 comprises a continuous sheet roller door 72 that is attached at its upper end to a roller 74 horizontally arranged over a door opening. The roller 74 is arranged to be motor driven in order to roll the door onto or off the roller. The lower end of the roller door 72 has attached thereto a safety edge 76 that may be of the type shown in FIG. 2.

Means for counterbalancing and tensioning the roller door 72 are provided at the sides of the door within door frame members 78. The counterbalancing means is shown in FIG. 3 and comprises a weight 80 attached to a pulley 82. A wire 84 is attached at one end to an upper part of the frame 78, passes under the pulley 82, and is attached at its other end to a drum 86 coaxially mounted on one end of the roller 74. The wire 84 is attached to the drum 86 so that, as the door 72 is rolled up onto the roller 74, the wire is fed off the drum and vice versa.

The tensioning means is in two parts. On the same side of the door as the counterbalancing means, there is a wire 90 attached to the door at its lower end. The wire 90 passes under a fixed pulley 92 at the bottom of frame 78, up to and over another fixed pulley 94 at the top of the frame 78, down to a free pulley 96, to which is attached a weight 98, and up to a fixed point 99 at the top of frame 78.

At the other side of the door there is a similar arrangement as already described and which is given the same reference numerals. In addition however, there is a wire 102 attached to the lower end of the door that passes under a fixed pulley 104 at the bottom of the frame 78, up to and over a fixed pulley 105 at the top of the frame 78, down to a free pulley 106 to which is attached a spring 108, the other end of which is attached to a fixed point 110 of the frame 78, and up to a fixed point 112 at the top of the frame 78.

The counterbalancing weight is selected to balance the weight of the door when it is in its closed position. As the counterbalancing force is ideally substantially equal to the product of the weight of the door fabric, safety beam and tension load W and the roller radius (which, of course, varies as the door rolls on or off the roller) then the counterbalance force needs to change to compensate that. The wire and spring system 102, 108 is provided to balance the counterbalance force. When the door is in its closed position the spring 108 is slack and when the door is in its open position the spring is taut. That has the effect of increasing the effective weight of the door fabric, and safety beam by applying a force in the direction of tension load W.

We claim:

1. A roller door assembly comprising:

a roller door having a substantially horizontal roller and bottom edge, motor means for driving the roller, means for tensioning said roller door, wherein a load is applied to said bottom edge of said roller door and means for counterbalancing the weight of the door, wherein a load is applied to said roller, the loads exerted by both said means being dependent on the amount of door off the roller and wherein the counterbalancing means comprises a drum attached to one end of the door roller, a wire on the drum that passes under a movable pulley and up to a fixed point, the wire rolling onto the drum in the opposite direction to that which the door rolls onto its roller, and means for compensating variations in the required counterbalancing force comprising spring means connected between the door and a fixed point whereby when the door is open the spring is taut and when the door is closed the spring is slack.

2. An assembly as claimed in claim 1, wherein:

the pulley carries a weight for exerting a load thereon.

3. An assembly as claimed in claim 1, wherein:

the counterbalancing load is chosen to compensate also for the load of the tensioning means.

4. An assembly as claimed in claim 3, having a safety beam of resilient foam or sponge material containing pneumatic tubes connected to a pneumatic switch for stopping a door motor.

5. An assembly as claimed in claim 4, wherein:

the beam is of rectangular section.

6. An assembly as claimed in claim 5, wherein:

the beam has a greater depth than width.

7. An assembly as claimed in claim 4, wherein:

the beam contains two pneumatic tubes, one in each of the lower quarters of the beam.

8. An assembly as claimed in claim 1, wherein:

the pulley carries a spring for exerting a load thereon.

9. A roller door assembly comprising a substantially horizontal roller and bottom edge, motor means for driving the roller, means for tensioning said roller door, wherein a load is applied to said bottom edge of said roller door and means for counterbalancing the weight of the door, wherein a load is applied to said roller, the loads exerted by both said means being dependent on the amount of door off the roller and wherein the counterbalancing means comprises a drum attached to one end of the door roller, a wire on the drum that passes under a movable pulley and up to a fixed point, the wire rolling onto the drum in the opposite direction to that which the door rolls onto its roller, and means for compensating variations in the required counterbalancing force comprising spring means connected between the door and a fixed point whereby when the door is open the spring is taut and when the door is closed the spring is slack.

* * * * *